US007540718B2

(12) United States Patent
Funami et al.

(10) Patent No.: US 7,540,718 B2
(45) Date of Patent: Jun. 2, 2009

(54) HERMETIC COMPRESSOR

(75) Inventors: Hitoshi Funami, Ikoma (JP); Katsunori Onobayashi, Otsu (JP)

(73) Assignee: Panasonic Corporation (JP)

( * ) Notice: Subject to any disclaimer, the term of this patent is extended or adjusted under 35 U.S.C. 154(b) by 400 days.

(21) Appl. No.: 11/103,684

(22) Filed: Apr. 12, 2005

(65) Prior Publication Data

US 2005/0226735 A1 Oct. 13, 2005

(30) Foreign Application Priority Data

Apr. 12, 2004 (JP) ..... 2004-116401

(51) Int. Cl.
*F04B 49/00* (2006.01)
*F04B 39/02* (2006.01)

(52) U.S. Cl. ..... 417/211.5; 417/228; 417/32; 417/36; 417/902; 310/68 R; 310/71

(58) Field of Classification Search ..... 417/211.5, 417/228, 410.3, 902, 13, 32, 36, 423.7; 310/67 R, 310/68 B, 68 R, 71, 87
See application file for complete search history.

(56) References Cited

U.S. PATENT DOCUMENTS 3,175,404 A * 3/1965 Entin ..... 73/514.06
3,339,829 A * 9/1967 Connor ..... 417/44.3
3,772,626 A * 11/1973 Russell ..... 336/192
4,135,186 A * 1/1979 Minorikawa et al. ..... 340/622
5,171,139 A * 12/1992 Underwood et al. ..... 418/48
6,888,124 B1 * 5/2005 Smith ..... 250/227.14
2002/0129650 A1 * 9/2002 Zimmermann et al. ..... 73/295
2003/0183001 A1 * 10/2003 Zimmermann et al. ..... 73/295

FOREIGN PATENT DOCUMENTS

JP 2001-012351 A 1/2001
JP 2001-32772 A 2/2001

OTHER PUBLICATIONS

Relevant Portion of Chinese Office Action issued for corresponding Chinese Patent Application No. 2005100642131, with date Feb. 2, 2007.

* cited by examiner

*Primary Examiner*—Devon C Kramer
*Assistant Examiner*—Leonard J Weinstein
(74) *Attorney, Agent, or Firm*—Rossi, Kimms & McDowell LLP

(57) ABSTRACT

A hermetic compressor comprises a hermetic container, an electric motor installed inside of the hermetic container, a compressing mechanism disposed within the hermetic container and driven by the electric motor, and an oil surface detector disposed to the compressing mechanism for detecting an oil surface of lubricating oil contained inside of the hermetic container. Here, the hermetic compressor is so constructed as to maintain a constant supply of the lubricating oil to the compressing mechanism by way of controlling operation in a manner to keep a surface level of the lubricating oil stable based on a detected result of the oil surface detector.

4 Claims, 2 Drawing Sheets

HERMETIC COMPRESSOR

FIELD OF THE INVENTION

The present invention relates to a hermetic compressor (hermetically-sealed compressor) for use in an indoor or outdoor unit of an air conditioner, a refrigeration system of refrigerator, and the like.

BACKGROUND OF THE INVENTION

A conventional hermetic compressor contains a certain amount of lubricating oil inside a hermetic container instead of supplying the oil forcibly from the outside of the compressor for the reason of its structural hurdles. Therefore, refrigerant containing the lubricating oil circulates through a refrigeration system and returns to a refrigerant inflow side of the compressor even if the oil is discharged with the refrigerant from the hermetic container. The structure constructed as above thus maintains the certain amount of oil at all the time and keeps lubrication of the compressing mechanism.

In the conventional hermetic compressor of this kind, however, there is a possibility of running short of an amount of returning oil depending on its operating condition, and this can cause a deficiency of lubrication. As one of measures for the above problem, therefore, temperature detecting devices are disposed to portions of the hermetic container, one in the oil and another in the gas above the oil surface, to take signals representing their temperatures, and to detect a level of the oil surface based on a difference between the two detected temperatures. The measures contrived here is to control an operating condition of the compressor according to the detected result in a manner to constantly maintain a proper amount of the oil retained therein. One example of such contrivances is disclosed in Japanese Patent Unexamined Publication, No. 2001-032772.

However, the above-described structure of the prior art requires not only two or more temperature detecting devices but also insulation terminals for mounting these temperature detecting devices individually to the hermetic container. There is hence a problem that the structure is complex and detection of accurate temperatures is difficult due to spatial limitation for mounting locations of the temperature detecting devices.

SUMMARY OF THE INVENTION

A hermetic compressor of the present invention comprises a hermetic container, an electric motor installed inside of the hermetic container, a compressing mechanism disposed within the hermetic container and driven by the electric motor, and an oil surface detector disposed to the compressing mechanism for detecting an oil surface of lubricating oil contained inside the hermetic container. Here, the hermetic compressor is so constructed as to maintain a constant supply of the lubricating oil to the compressing mechanism by way of controlling operation in a manner to keep a surface level of the lubricating oil stable based on a detected result of the oil surface detector.

DETAILED DESCRIPTION OF PREFERRED EMBODIMENT

A hermetic compressor of the present invention comprises a hermetic container, an electric motor installed inside of the hermetic container, a compressing mechanism disposed within the hermetic container and driven by the electric motor, and an oil surface detector disposed to the compressing mechanism for detecting an oil surface of lubricating oil contained inside the hermetic container. Here, the hermetic compressor is so constructed as to maintain a constant supply of the lubricating oil to the compressing mechanism by way of controlling operation in a manner to keep a surface level of the lubricating oil stable based on a detected result of the oil surface detector.

In the hermetic compressor of this invention described above, the oil surface detector is provided with two temperature sensing elements (hereinafter referred to as "sensor") positioned across the surface of the lubricating oil, one in the oil and the other in the gas above the oil surface, and this oil surface detector is disposed to the compressing mechanism.

Wiring conductors to the oil surface detector are routed through one of insertion grooves, so-called slots, provided for a stator winding of the electric motor. In addition, leading ends of the wiring conductors are connected to special terminals prepared exclusively for wiring the oil surface detector provided in a power-supply terminal unit for the electric motor, and led to the outside of the hermetic container.

According to this embodiment, a surface level of the oil in the compressing mechanism can be detected accurately with the simple structure, thereby providing an outstanding advantage of improving reliability of the hermetic compressor.

Description will be provided in more detail of the embodiment according to this invention with reference to the drawings. However, the embodiment described herein is not meant to restrict the scope of the present invention.

Figure 1:
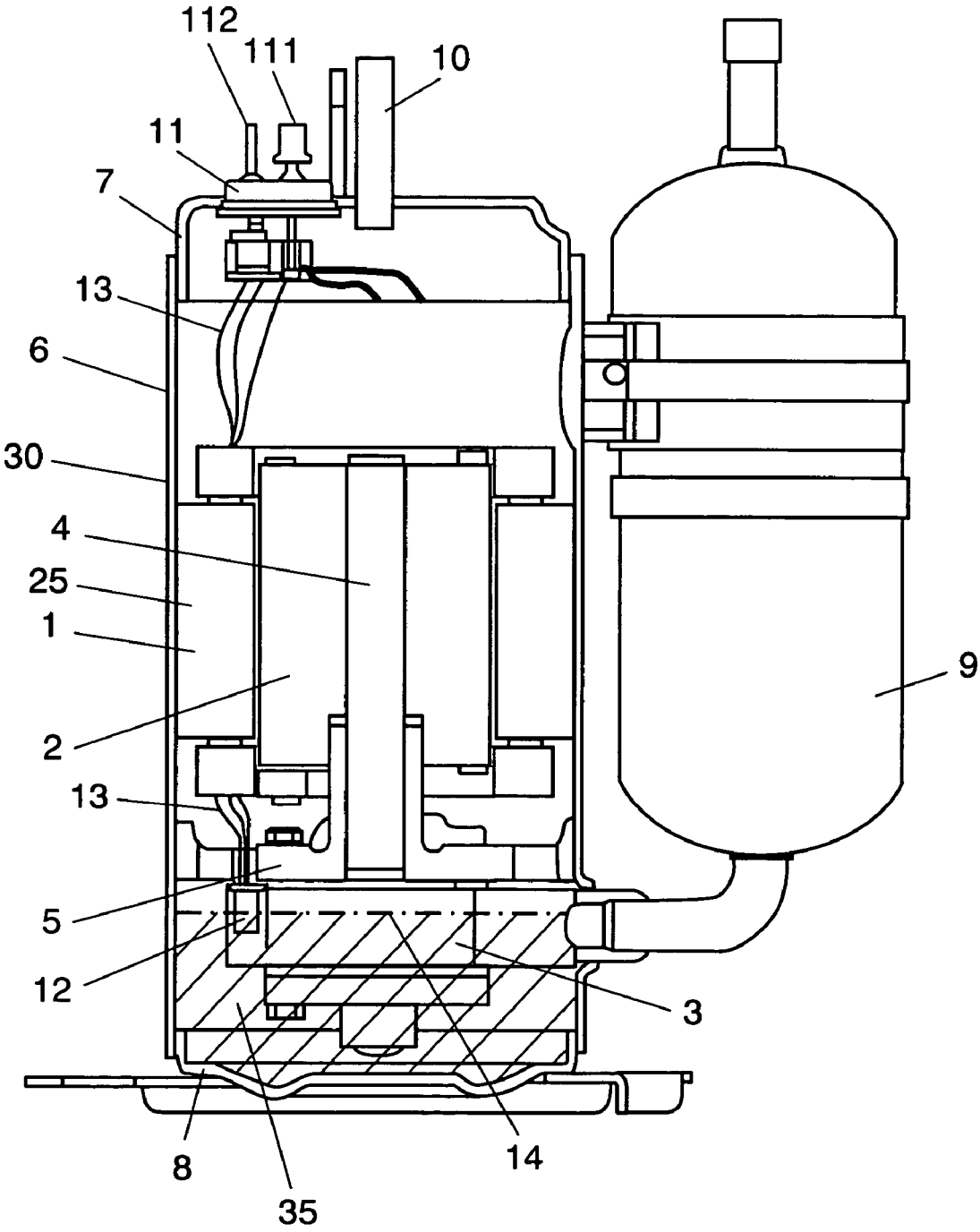
FIG. 1 is a sectional view of a hermetic compressor according to an exemplary embodiment of the present invention.

FIG. 1 is a sectional view of the hermetic compressor according to this embodiment of the invention. In FIG. 1, hermetic container 30 comprises body shell 6, and top and bottom shells 7 and 8 secured to body shell 6 at the upper and lower ends respectively. Stator 1 of electric motor 25 is secured by tight-fitting to body shell 6. Rotator 2 of electric motor 25 is fixed to rotary shaft 4 of compressing mechanism 3. Bearing 5 supports rotary shaft 4 in a rotatable manner.

Top shell 7 has discharge pipe 10 mounted thereto for discharging the refrigerant during refrigeration cycle. Top shell 7 also has power-supply terminal unit 11 mounted thereto for electric motor 25. This power-supply terminal unit 11 is provided with terminals 111 for feeding power to electric motor 25 and special terminals 112 for connection with wiring conductors 13 to oil surface detector 12. Body shell 6 has accumulator 9 mounted to it.

Oil surface detector 12 is disposed to compressing mechanism 3 for detecting a level of oil surface 14 of lubricating oil 35 retained inside hermetic container 30.

Figure 2:
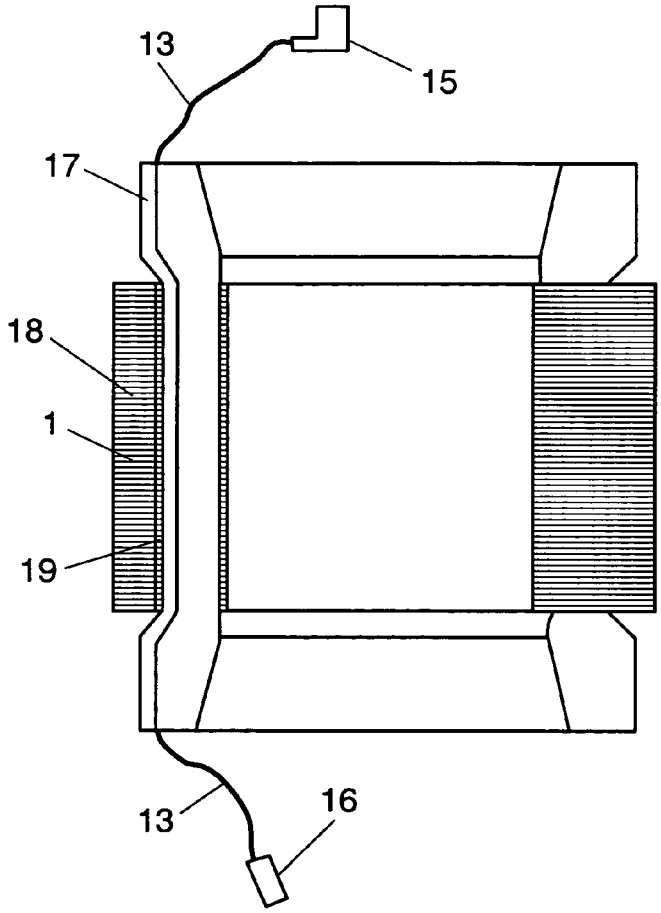
FIG. 2 is a sectional view of a stator of an electric motor of the hermetic compressor according to the exemplary embodiment of this invention.

FIG. 2 is a sectional view of the stator of the electric motor for the hermetic compressor according to this embodiment of the invention. In FIG. 2, stator core 18 is composed of a plurality of laminated magnetic steels. Stator core 18 has a plurality of insertion grooves, so-called slots 19, formed for insertion of stator winding 17. Stator core 18 and stator winding 17 inserted in slots 19 compose stator 1 of the electric motor.

Wiring conductors 13 for the oil surface detector 12 are routed through one of insertion grooves (slots) 19 for stator winding 17 of the electric motor. Both ends of wiring conductors 13 are terminated with respective connectors 15 and 16. Although there are actually three each of wiring conductors 13, connectors 15 and connectors 16, FIG. 2 shows only one each of them to represent others.

The ends of wiring conductors 13 are connected by using connectors 15 to special terminals 112 prepared exclusively for wiring the oil surface detector 12 provided in power-supply terminal unit 11 for the electric motor, and led to the outside of hermetic container 30.

In this embodiment, special wires prepared independently from stator winding 17 are used for wiring conductors 13. However, the special wires may be wound beforehand along with stator winding 17.

Figure 3:
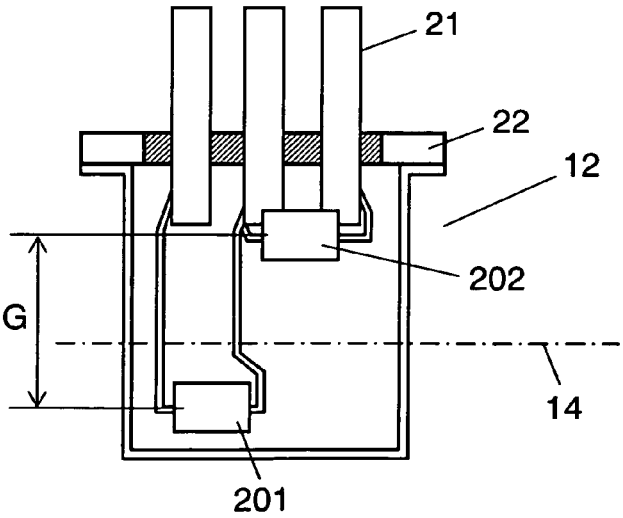
FIG. 3 is a plan view of an oil surface detector according to the exemplary embodiment of this invention.

Referring to the accompanying drawing, description is provided next of the oil surface detector 12. FIG. 3 is a plane view of the oil surface detector 12 according to this embodiment of the invention.

In FIG. 3, the oil surface detector 12 is disposed across oil surface 14 in such a manner that first sensor (temperature sensing element) 201 and second sensor (temperature sensing element) 202 are respectively located in the oil and in the gas above the oil surface 14. These sensors are positioned with a predetermined space "G" between them.

There are supply conductors and a signal conductor wired between three connecting terminals 21 and first and second sensors 201 and 202. A part of protective casing 22 is cut open, and three connecting terminals 21 of the oil surface detector 12 are disposed in a manner to penetrate through protective casing 22. Each of three connectors 16 of wiring conductors 13 shown in FIG. 2 is connected to the respective one of three connecting terminals 21 shown in FIG. 3.

The oil surface detector 12 constructed as above operates in a manner which is described next.

First sensor 201 and second sensor 202 are mounted to such locations in the oil surface detector 12 that a given level of oil surface 14 such as the one shown in FIG. 3, for example, comes to a mid position between these two sensors. In this instance, first sensor 201 is disposed in a location where it can detect the lowest limit of the oil surface.

Electric currents of a predetermined amount are supplied to both sensors 201 and 202 during operation of the hermetic compressor. These electric currents generate Joule heats in both sensors 201 and 202. The generated heats thus cause increase in resistances of both sensors 201 and 202. Since a rate of thermal radiation in the oil is different as compared to that in the gas, there occurs a difference in resistance value between the two sensors 201 and 202. It is therefore possible to judge that oil surface 14 is in a level between these sensors 201 and 202 when there is a difference in the resistance between them.

On the other hand, when there is no difference in the resistance between sensors 201 and 202, the following two states are considered to exist. One is a state in which both sensors 201 and 202 are located in the gas, indicating an insufficient amount of the oil. The other may be a state in which both sensors 201 and 202 are located in the oil. However, it is not possible that the oil surface raises above a level set initially in the hermetic compressor, since there is no external supply of the oil. In other words, the latter state is impossible. Therefore, it is determined that the amount of oil becomes insufficient when there is no difference in the resistance between two sensors 201 and 202.

It is assumed here that the difference of resistances between the two sensors becomes smaller and a sensitivity of detection declines when the space "G" between the two sensors is set too small, since the oil and gas get mixed turbidly in the vicinity of the oil surface. The space "G" between the two sensors is hence set to an optimum distance in order to produce a highest level of detecting sensitivity for each individual type of hermetic compressors.

In another case in which two or more hermetic compressors are used in series, there can occur a phenomenon that the lubricating oil decreases in one compressor and the lubricating oil increases in another compressor, thereby resulting in no difference of resistance between sensors of the both compressors.

In the above case, it is possible to restore a predetermined level of the original oil surface by providing an oil-equalizing valve, for instance, and repeating operation of moving the lubricating oil from one compressor to another until the difference of resistance becomes cleared between two sensors in each of the compressors, since a gross amount of the lubricating oil is fixed.

According to the present invention, as is obvious from the above teaching, the oil surface detector for the lubricating oil is disposed to the compressing mechanism, so that a surface level of the oil retained in the hermetic compressor is determined accurately based on a result of detection by the oil surface detector. The lubricating oil is supplied steadily to the compressing mechanism by way of controlling operation in a manner to maintain the surface level of the oil stable around the compressing mechanism.

Moreover, wiring of the supply conductors and signal conductor to the oil surface detector is made through one of insertion grooves (slots) for the stator winding of the electric motor, and they are lead to the outside of the hermetic container via the special terminals provided in the power-supply terminal unit for the electric motor. This structure makes a special-purpose wiring path unnecessary, and the wiring conductors share the same insulation structure of the slot with the stator winding.

Alternatively, wires used for the oil surface detector independently of the stator winding may be wound beforehand together with the stator winding, and this batch of the wound wires is inserted into the insertion groove (slot) for the stator winding of the electric motor, so that the assembly work can be simplified.

As described, the hermetic compressor of the present invention can detect a surface level of the oil accurately with the simple structure as compared with the conventional hermetic compressor. The invention can also achieve easy installation of the oil surface detector to the compressing mechanism.

What is claimed is:

1. A hermetic compressor comprising:

(a) a hermetic container having a body shell;

(b) an electric motor installed inside of the hermetic container;

(c) a compressing mechanism disposed within the hermetic container and driven by the electric motor; and (d) an oil surface detector disposed for detecting an oil surface of lubricating oil contained inside of the hermetic container, wherein the electric motor includes a stator and a rotator, and the stator is secured against an inner surface of the body shell, and the rotator is rotatably mounted relative to the stator, wherein a constant supply of the lubricating oil to the compressing mechanism is maintainable based on a detected result of the oil surface detector, wherein the stator includes a stator core comprised of a plurality of laminated magnetic members, a plurality of insertion grooves, and a stator winding inserted in the insertion groove, and wherein the oil surface detector includes an electrical wiring that is discrete and separate from the stator winding and routed through the stator core via one of the insertion grooves so that the wiring extends above and below the stator.

2. The hermetic compressor according to claim 1, wherein the oil surface detector includes two temperature sensing elements disposed thereto in positions across the oil surface so that the temperature sensing elements are located individually in the lubricating oil and in gas above the oil surface.

3. The hermetic compressor according to claim 1, wherein a leading end of the wiring is connected to a special terminal prepared exclusively for wiring the oil surface detector provided in a power-supply terminal unit for the electric motor, and led to the outside of the hermetic container.

4. The hermetic compressor according to claim 1, wherein the plurality of insertion grooves extend between both end faces of the laminated members.

* * * * *